US012060138B1

(12) United States Patent
Farrell

(10) Patent No.: US 12,060,138 B1
(45) Date of Patent: Aug. 13, 2024

(54) CONVERTIBLE SEATING AND BED SYSTEM FOR MARINE VESSELS

(71) Applicant: Brunswick Corporation, Mettawa, IL (US)

(72) Inventor: Kevin T. Farrell, New Smyrna Beach, FL (US)

(73) Assignee: Brunswick Corporation, Mettawa, IL (US)

( * ) Notice: Subject to any disclaimer, the term of this patent is extended or adjusted under 35 U.S.C. 154(b) by 361 days.

(21) Appl. No.: 17/531,168

(22) Filed: Nov. 19, 2021

Related U.S. Application Data

(60) Provisional application No. 63/119,880, filed on Dec. 1, 2020.

(51) Int. Cl.
*B63B 29/04* (2006.01)

(52) U.S. Cl.
CPC ..... *B63B 29/04* (2013.01); *B63B 2029/043* (2013.01)

(58) Field of Classification Search
CPC ..... B63B 29/04; B63B 2029/043
See application file for complete search history.

(56) References Cited

U.S. PATENT DOCUMENTS

| | | | |
|---|---|---|---|
| 250,597 | A | 12/1881 | John |
| 427,413 | A | 5/1890 | Fritz |
| 831,877 | A | 9/1906 | Kling |
| 1,224,982 | A | 5/1917 | Washeim |
| 1,271,830 | A | 7/1918 | Austin |
| 1,782,231 | A | 11/1930 | William et al. |
| 1,792,737 | A | 2/1931 | Greenstreet |
| 2,076,309 | A | 4/1937 | Whedon |
| 2,113,346 | A | 4/1938 | Heath |
| 2,486,468 | A | 11/1949 | Harry |
| 2,900,009 | A | 8/1959 | Haynes |

(Continued)

FOREIGN PATENT DOCUMENTS

| | | |
|---|---|---|
| CN | 109693587 | 4/2019 |
| DE | 19501521 | 7/1995 |

(Continued)

OTHER PUBLICATIONS

Chris-Craft, Catalina 24. Retrieved from the web: https://www.chriscraft.com/models/catalina-series/catalina-24/ on Jan. 11, 2022.

*Primary Examiner* — Anthony D Wiest
(74) *Attorney, Agent, or Firm* — Andrus Intellectual Property Law, LLP

(57) ABSTRACT

A convertible seating system for a marine vessel that is movable between a seating configuration and a bed configuration is provided. The convertible seating system includes a seating structural component, a backrest structural component that is pivotably coupled to the seating structural component, and an actuator assembly that is coupled to the seating structural component and positioned within a recessed portion of a deck surface of the marine vessel. The actuator assembly is configured to drive the seating structural component from a lower and inward position relative to the deck surface when the convertible seating system is in the seating configuration to a higher and outward position relative to the deck surface when the convertible seating system is in the bed configuration.

20 Claims, 7 Drawing Sheets

(56) References Cited

U.S. PATENT DOCUMENTS

| | | | |
|---|---|---|---|
| 2,969,107 | A | 1/1961 | Ira et al. |
| 3,107,940 | A | 10/1963 | Brooks et al. |
| 3,379,471 | A | 4/1968 | Dalziel |
| 3,482,870 | A | 12/1969 | Janssen |
| 3,506,303 | A | 4/1970 | Smittle et al. |
| 3,643,528 | A | 2/1972 | Van Der Loos |
| 3,743,350 | A | 7/1973 | Allen |
| 3,839,757 | A | 10/1974 | Grimes |
| 3,877,747 | A | 4/1975 | Brennan et al. |
| 3,884,522 | A | 5/1975 | Arima et al. |
| 4,030,436 | A | 6/1977 | Stoberl |
| 4,088,040 | A | 5/1978 | Ross-Myring |
| 4,099,768 | A | 7/1978 | Amos |
| 4,536,027 | A | 8/1985 | Brennan |
| 4,558,901 | A | 12/1985 | Yokoyama |
| 4,567,845 | A | 2/1986 | Smith |
| 4,693,204 | A | 9/1987 | Klein |
| 4,736,982 | A | 4/1988 | Hwang |
| 4,738,217 | A | 4/1988 | Smith |
| 4,775,187 | A | 10/1988 | Herr |
| 4,843,999 | A | 7/1989 | Kobus et al. |
| 1,854,261 | A | 8/1989 | Goldsmith |
| 4,926,783 | A | 5/1990 | Lathers |
| 5,052,076 | A | 10/1991 | Spaeth |
| 5,052,748 | A | 10/1991 | Fourrey et al. |
| 5,054,857 | A | 10/1991 | Kvalheim |
| 5,107,720 | A | 4/1992 | Hatfield |
| 5,136,963 | A | 8/1992 | Zuzik |
| 5,171,064 | A | 12/1992 | Boussaroque |
| 5,261,727 | A | 11/1993 | Klaebel |
| 5,313,033 | A | 5/1994 | Link et al. |
| 5,320,059 | A | 6/1994 | Ikeda |
| 5,329,871 | A | 7/1994 | Gibbs |
| 5,374,108 | A | 12/1994 | Saul et al. |
| 5,375,907 | A | 12/1994 | Rogers et al. |
| 5,381,585 | A | 1/1995 | Olson et al. |
| 5,531,506 | A | 7/1996 | Scott |
| 5,553,920 | A | 9/1996 | Meschkat et al. |
| 5,613,662 | A | 3/1997 | Blackmore |
| 5,762,402 | A | 6/1998 | Gillotti |
| 5,782,534 | A | 7/1998 | Desanta |
| 5,799,605 | A | 9/1998 | Huse |
| 5,842,743 | A | 12/1998 | Wright et al. |
| 5,904,401 | A | 5/1999 | Alberda et al. |
| 5,913,571 | A | 6/1999 | Dystra et al. |
| 5,976,160 | A | 11/1999 | Crainich |
| 6,196,629 | B1 | 3/2001 | Onishi et al. |
| 6,230,648 | B1 | 5/2001 | Davidson et al. |
| 6,257,667 | B1 | 7/2001 | Boren et al. |
| 6,283,059 | B1 | 9/2001 | Scully, Jr. |
| 6,527,341 | B1 | 3/2003 | Martin |
| D481,986 | S | 11/2003 | Menne |
| 6,647,916 | B2 | 11/2003 | Neese et al. |
| 6,766,759 | B2 | 7/2004 | Eck et al. |
| 6,789,494 | B2 | 9/2004 | Neese et al. |
| 6,866,022 | B1 | 3/2005 | Phillips et al. |
| 6,880,482 | B2 | 4/2005 | Huse |
| 6,883,458 | B2 | 4/2005 | Huse |
| 6,918,160 | B1 | 7/2005 | Clark |
| 6,940,026 | B2 | 9/2005 | Rundell et al. |
| 6,945,190 | B1 | 9/2005 | Frandsen |
| 7,000,557 | B1 | 2/2006 | Forbes et al. |
| 7,107,927 | B2 | 9/2006 | Hopper et al. |
| 7,121,218 | B2 | 10/2006 | Stinson et al. |
| 7,156,442 | B2 | 1/2007 | McManus |
| 7,172,252 | B2 | 2/2007 | Henning |
| 7,255,058 | B2 | 8/2007 | Forbes et al. |
| 7,302,906 | B2 | 12/2007 | Burroughs et al. |
| 7,341,306 | B1 | 3/2008 | Neese et al. |
| 7,367,616 | B2 | 5/2008 | Summerford |
| 7,513,211 | B1 | 4/2009 | Farb et al. |
| 7,647,880 | B2 | 1/2010 | Devine |
| 7,661,382 | B2 | 2/2010 | Wood et al. |
| 7,677,668 | B2 | 3/2010 | Olsen et al. |
| 7,699,390 | B2 | 4/2010 | Baumann |
| 7,819,483 | B2 | 10/2010 | Kushner et al. |
| 7,828,383 | B1 | 11/2010 | Urbanek et al. |
| 8,002,350 | B2 | 8/2011 | Johnson |
| 8,028,641 | B1 | 10/2011 | Sly |
| 8,109,563 | B2 | 2/2012 | Hansen |
| 8,113,136 | B2 | 2/2012 | Mayrand et al. |
| 8,113,137 | B2 | 2/2012 | Thompson |
| 8,113,589 | B2 | 2/2012 | Mildt et al. |
| 8,499,377 | B2 | 8/2013 | Fafard et al. |
| 8,517,466 | B1 | 8/2013 | Wizorek et al. |
| 8,720,990 | B2 | 5/2014 | Boydston |
| 8,740,297 | B1 | 6/2014 | Foss et al. |
| 8,801,099 | B2 | 8/2014 | Ebel et al. |
| 8,840,175 | B2 | 9/2014 | Short |
| 8,899,169 | B1 | 12/2014 | Jaziri |
| 9,021,975 | B1 | 5/2015 | Fodor et al. |
| 9,067,517 | B1 | 6/2015 | Roeglin et al. |
| 9,073,608 | B1 | 7/2015 | Foss et al. |
| D743,318 | S | 11/2015 | Curts |
| 9,260,166 | B1 | 2/2016 | Fodor et al. |
| 9,315,238 | B2 | 4/2016 | Neese et al. |
| 9,370,245 | B2 | 6/2016 | Fafard et al. |
| 9,403,597 | B2 | 8/2016 | Ferry et al. |
| 9,440,560 | B2 | 9/2016 | Neese et al. |
| 9,487,273 | B1 | 11/2016 | Eekhoff et al. |
| 9,527,555 | B2 | 12/2016 | Ketterman et al. |
| 9,650,117 | B2 | 5/2017 | Curts et al. |
| 9,688,168 | B2 | 6/2017 | Gratz |
| 9,701,368 | B2 | 7/2017 | Neese et al. |
| D794,537 | S | 8/2017 | Wagnon |
| 9,783,271 | B2 | 10/2017 | Foss et al. |
| 9,821,887 | B1 | 11/2017 | Wilson et al. |
| 9,907,404 | B1 | 3/2018 | Sorel et al. |
| 9,919,625 | B1 | 3/2018 | Barbier et al. |
| D819,540 | S | 6/2018 | Wilson et al. |
| 10,005,380 | B2 | 6/2018 | Reid et al. |
| D824,836 | S | 8/2018 | Deurr |
| 10,065,711 | B2 | 9/2018 | Fuller, IV et al. |
| 10,065,713 | B2 | 9/2018 | Murphy |
| D830,944 | S | 10/2018 | Deurr |
| 10,085,566 | B1 | 10/2018 | Gallant |
| 10,149,544 | B2 | 12/2018 | Fafard et al. |
| 10,150,539 | B1 | 12/2018 | Wilson et al. |
| 10,207,776 | B1 | 2/2019 | Downey et al. |
| 10,328,836 | B2 | 6/2019 | Purwin et al. |
| 10,422,167 | B2 | 9/2019 | Huerta et al. |
| D864,081 | S | 10/2019 | Barbier et al. |
| 10,464,639 | B2 | 11/2019 | Neese et al. |
| 10,471,859 | B2 | 11/2019 | Harrison, III et al. |
| 10,479,233 | B2 | 11/2019 | Minato et al. |
| 10,486,777 | B1 | 11/2019 | Barbier et al. |
| D870,016 | S | 12/2019 | Wilson et al. |
| 10,494,061 | B2 | 12/2019 | Fafard et al. |
| 10,556,645 | B1 | 2/2020 | Levin |
| 10,569,841 | B2 | 2/2020 | Fuller, IV et al. |
| 10,759,502 | B2 | 9/2020 | Fafard et al. |
| 10,933,774 | B2 | 3/2021 | Curts |
| 11,034,414 | B1 | 6/2021 | Wilson et al. |
| 11,174,893 | B1 | 11/2021 | Freer et al. |
| 11,195,368 | B2 | 12/2021 | Patel et al. |
| 11,286,022 | B1 | 3/2022 | Freer |
| 2003/0197402 | A1 | 10/2003 | McCutcheon et al. |
| 2003/0218369 | A1 | 11/2003 | Akaike et al. |
| 2006/0103174 | A1 | 5/2006 | Queveau et al. |
| 2007/0114819 | A1 | 5/2007 | Dougherty |
| 2007/0158986 | A1 | 7/2007 | Adams et al. |
| 2008/0196649 | A1 | 8/2008 | Kalil |
| 2008/0236452 | A1 | 10/2008 | Pratt et al. |
| 2009/0261629 | A1 | 10/2009 | Fafard et al. |
| 2009/0277372 | A1 | 11/2009 | Wood et al. |
| 2010/0018451 | A1 | 1/2010 | Sahr |
| 2010/0037813 | A1 | 2/2010 | Sahr et al. |
| 2010/0037814 | A1 | 2/2010 | Sahr et al. |
| 2010/0201163 | A1 | 8/2010 | Dunkel |
| 2011/0057483 | A1 | 3/2011 | Dickey et al. |
| 2011/0109136 | A1 | 5/2011 | Fafard et al. |
| 2011/0226900 | A1 | 9/2011 | Bamford et al. |
| 2014/0216327 | A1 | 8/2014 | Chen |
| 2014/0265500 | A1 | 9/2014 | Hough et al. |

(56) References Cited

U.S. PATENT DOCUMENTS

| | | | | |
|---|---|---|---|---|
| 2016/0152169 | A1 | 6/2016 | Zheng et al. | |
| 2017/0233042 | A1 | 8/2017 | Curts et al. | |
| 2019/0104849 | A1 | 4/2019 | Fafard et al. | |
| 2020/0130786 | A1* | 4/2020 | Ekern | B63B 29/04 |
| 2020/0337467 | A1 | 10/2020 | Cannon | |
| 2020/0398944 | A1 | 12/2020 | Fafard et al. | |
| 2021/0169229 | A1 | 6/2021 | Niemela et al. | |
| 2021/0214052 | A1 | 7/2021 | Mast | |
| 2022/0126953 | A1* | 4/2022 | Rosengren | B63H 20/08 |
| 2022/0258835 | A1 | 8/2022 | Curts | |

FOREIGN PATENT DOCUMENTS

| | | |
|---|---|---|
| DE | 60207263 | 7/2006 |
| DE | 102011086751 | 5/2013 |
| GB | 635957 | 4/1950 |
| WO | WO 2019222749 | 11/2019 |

* cited by examiner

CONVERTIBLE SEATING AND BED SYSTEM FOR MARINE VESSELS

CROSS-REFERENCE TO RELATED APPLICATION

The present application claims the benefit of and priority to U.S. Provisional Application Ser. No. 63/119,880, filed Dec. 1, 2020, which application is hereby incorporated by reference in its entirety.

FIELD

The present disclosure relates to marine vessels and watercraft, and more particularly, pertains to a convertible seating system for marine vessels and watercraft that is movable between a seating configuration and a bed configuration.

BACKGROUND

U.S. Pat. No. 5,799,605 discloses an expandable seat and storage unit particularly adapted for use in a boat. The expandable seat has a base unit which defines a storage area. A frame is slidably mounted within the base and can slide with respect to the base to expand the length of the seat to form a bed. The frame is locked into the base by the back cushion of the seat. By removing the back cushion, the frame section can be slid out of the base and then the back cushion can be used along with the seat cushion to form a bed. The frame has side members which extend generally perpendicular from the side edges of the front face of the frame and ride in tracks formed in the base unit. The tracks are along the sides of the base unit and do not interfere with the storage area. Further, the tracks are formed integrally in the base unit to facilitate easy inexpensive manufacture and operation.

U.S. Pat. No. 7,513,211 discloses a seat assembly for use in boats. The seat assembly includes a pair of seating platforms with a reclining seat back and a sliding seat bottom. A removable section is inserted between the seat bottom and the seat back to create a long recliner. A central panel and pad are set between the seating platforms to create a large surface area sunpad. The seating platforms are hollow to allow for storage of the central panels and pads and the removable sections.

U.S. Pat. No. 8,517,466 discloses a convertible boat seat that transforms from a standard bench-style seat configuration capable of accommodating multiple occupants to a lounger that allows a single occupant to comfortably lounge without impeding into the available deck space. A convertible boat seat comprises a chaise lounge type seat having a plurality of configurable components including a two-piece back rest, a configurable armrest, a hinging bench seat assembly, and an inclined chaise end forming a lounge backrest adapted with a pivoting armrest. The two-piece backrest includes first and second backrest components that are cach configurable between a raised position and a lowered position. The inclined chaise end includes a pivoting armrest configurable between a stowed, out-of-the-way position, and a deployed position wherein it functions as a lounge armrest. A hinging bench seat includes first and second hingedly connected seat components that are configurable between a generally flat configuration for bench seating and a raised configuration wherein the lounger's knees are supported in a partially bent lounging position. On an opposing end of the inclined chaise end is an armrest configurable between a raised position wherein it functions as an armrest when the seat is configured for bench-style seating, and a lowered position wherein it is stowed generally flush with the bench seat surface for providing increased leg room while lounging.

U.S. Pat. No. 8,899,169 discloses a platform for a vessel that includes integrated and stowable seating. The platform comprises a platform surface, at least one seating recess, and at least one seat back panel. The seating recess is disposed below the platform surface. The seat back panel has an inner surface and an opposing outer surface and is pivotably attached to the seating recess to provide a plurality of operative positions, including an open seating position and a closed position. In the closed position, the outer surface of the seat back panel is substantially flush with respect to the platform surface, providing a continuous and unobstructed boarding/swimming platform. The open seating position provides an aftward seating configuration. Both the seating recess and seat back panel can removably receive cushions for added comfort and support of the user. The configuration maximizes usable platform space when the seat back panels are closed.

U.S. Pat. No. 9,021,975 discloses a seating system for marine vessels and watercraft including a chair having a backrest and a seat bottom and a lounge extension element wherein a first end of the extension element is hingeably attached to and extends from the seat bottom and wherein a second end of the extension element is configured to be hingeably attached to a first rigid structure such as a bulkhead on a watercraft. The seating system is convertible between a forward-facing seat configuration and an aft-facing lounger configuration. In the aft-facing lounger configuration, the extension element and the seat bottom are substantially parallel to one another. In the forward-facing seat configuration, the extension element is substantially upright and at an acute angle with respect to said seat bottom.

U.S. Pat. No. 9,073,608 discloses a seating system for watercraft having a base supporting a seating surface and a backrest pivotably attached to the base. The backrest pivots about the seating surface to provide a plurality of selectable seating positions. The backrest is pivotably attached to the base by an arm attached to the side of the backrest. The arm engages a guide member attached to the base, the guide member having one or more positional slots corresponding to the plurality of selectable seating positions. The backrest can be positioned upright, at an angle, or flat with respect to the seating surface to provide a plurality of seating configurations including simultaneous forward and aft seats, an aft-facing lounge seat and a sunpad. The seating surface comprises hingeable seat cushions permitted access to storage compartments inside the base. The seating system can be installed adjacent to a bulkhead on a watercraft to provide an aft-facing lounge seat.

U.S. Pat. No. 9,260,166 discloses a seat for a marine vessel capable of multiple positions while maintaining a hidden or concealed look when closed. The seat has a seat back hingeably attached to a seat bottom and a seat back cap hingeably attached to a leading edge of the seat back. The seat is operable between a plurality of selected positions including an open position and a closed position. In the open position, the seat back is upright and the seat provides at least one traditional seating surface. In the closed position, the seat back rests substantially parallel on the seat bottom and a rear surface of the seat back functions as a sun pad. In the closed position, the seat back cap is deployed over a leading edge of the seat bottom and the leading edge of the seat back to conceal the seat. A positionable leg extension pad extends from the seat bottom.

U.S. Pat. No. 9,821,887 discloses a convertible seating system for a marine vessel includes a frame and a seat mounted on the frame and defining a first support surface. A backrest is configured for movement relative to the seat and the frame between a first position and a second position. In the second position, the backrest defines a second support surface lying generally parallel and vertically displaced relative to the first support surface.

U.S. Pat. No. 10,085,566 discloses a marine vessel that has a deck surface having a recessed cavity; a seat module having a seating member, an engagement member, and a hinge that couples the seating member to the engagement member; and a retainer configured to retain the engagement member with respect to the recessed cavity. The seating member is pivotable about the hinge into and between a closed position in which the seating member lies flush with the deck surface and covers the recessed cavity and an open position in which the seating member provides seating for user and the recessed cavity is exposed and provides leg room for the user.

U.S. Pat. No. 10,486,777 discloses a seating system that includes a base, and a seat mounted on the base and defining a seating surface. A backrest is configured for movement relative to the base and the seat between a first position and a second position by a backrest transfer arrangement having a movable pivot axis configuration. In the second position, the backrest defines a working surface spaced above and lying generally parallel to the seating surface. Each of the above patents is hereby incorporated herein by reference in its entirety.

SUMMARY

This Summary is provided to introduce a selection of concepts that are further described herein below in the Detailed Description. This Summary is not intended to identify key or essential features of the claimed subject matter, nor is it intended to be used as an aid in limiting the scope of the claimed subject matter.

According to one example of the present disclosure, a convertible seating system for a marine vessel that is movable between a seating configuration and a bed configuration is provided. The convertible seating system includes a seating structural component, a backrest structural component that is pivotably coupled to the seating structural component, and an actuator assembly that is coupled to the seating structural component and positioned within a recessed portion of a deck surface of the marine vessel. The actuator assembly is configured to drive the seating structural component from a lower and inward position relative to the deck surface when the convertible seating system is in the seating configuration to a higher and outward position relative to the deck surface when the convertible seating system is in the bed configuration.

According to another example of the present disclosure, a convertible seating system for a marine vessel that is movable between a seating configuration and a bed configuration is provided. The convertible seating system includes a seating structural component, a backrest structural component that is pivotably coupled to the seating structural component, and an actuator assembly coupled to the seating structural component and positioned within a recessed portion of a deck surface of the marine vessel. The actuator assembly is configured to drive the seating structural component between the seating configuration and the bed configuration. A seating surface provided by the convertible seating system is contiguous with a seating surface provided by a stationary sofa system when the convertible seating system is in the seating configuration. A bed surface provided by the convertible seating system is of a continuous height with a bed surface provided by a stationary support component when the convertible seating system is in the bed configuration.

According to yet another example of the present disclosure, a convertible seating system for a marine vessel that is movable between a seating configuration and a bed configuration is provided. The convertible seating system includes a seating structural component, a backrest structural component that is pivotably coupled to the seating structural component, and an actuator assembly coupled to the seating structural component and positioned within a recessed portion of a deck surface of the marine vessel. The actuator assembly configured to drive the seating structural component between a first height when the convertible seating system is in the seating configuration and a second height when the convertible seating system is in the bed configuration, where the first height is not equal to the second height.

BRIEF DESCRIPTION OF THE DRAWINGS

The present disclosure is described with reference to the following FIGURES. The same numbers are used throughout the FIGURES to reference like features and like components.

DETAILED DESCRIPTION

Figure 1:
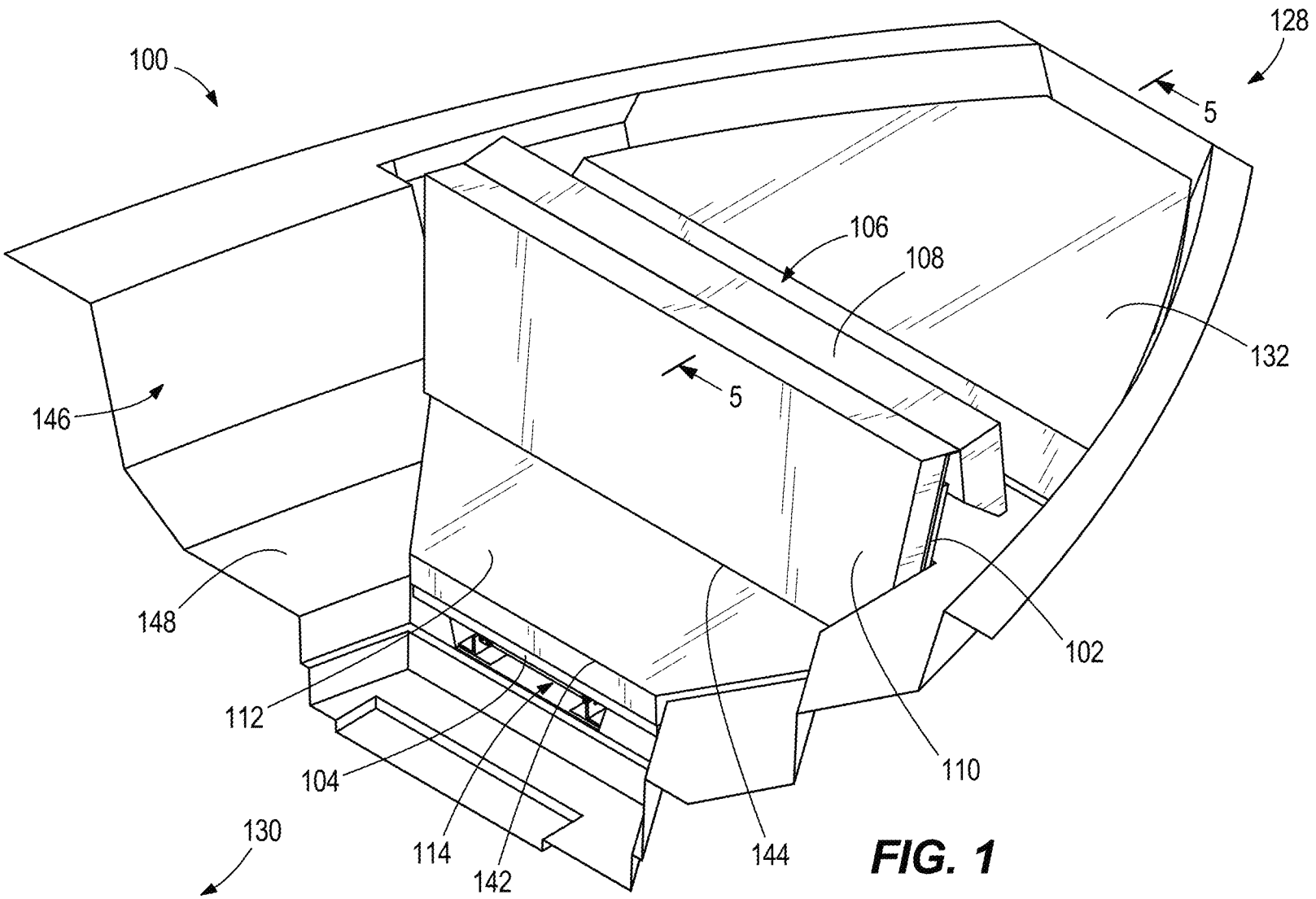
FIG. 1 is a perspective view of a boat provided with a convertible seating and bed system in accordance with the present disclosure and showing a seating configuration.
Figure 2:
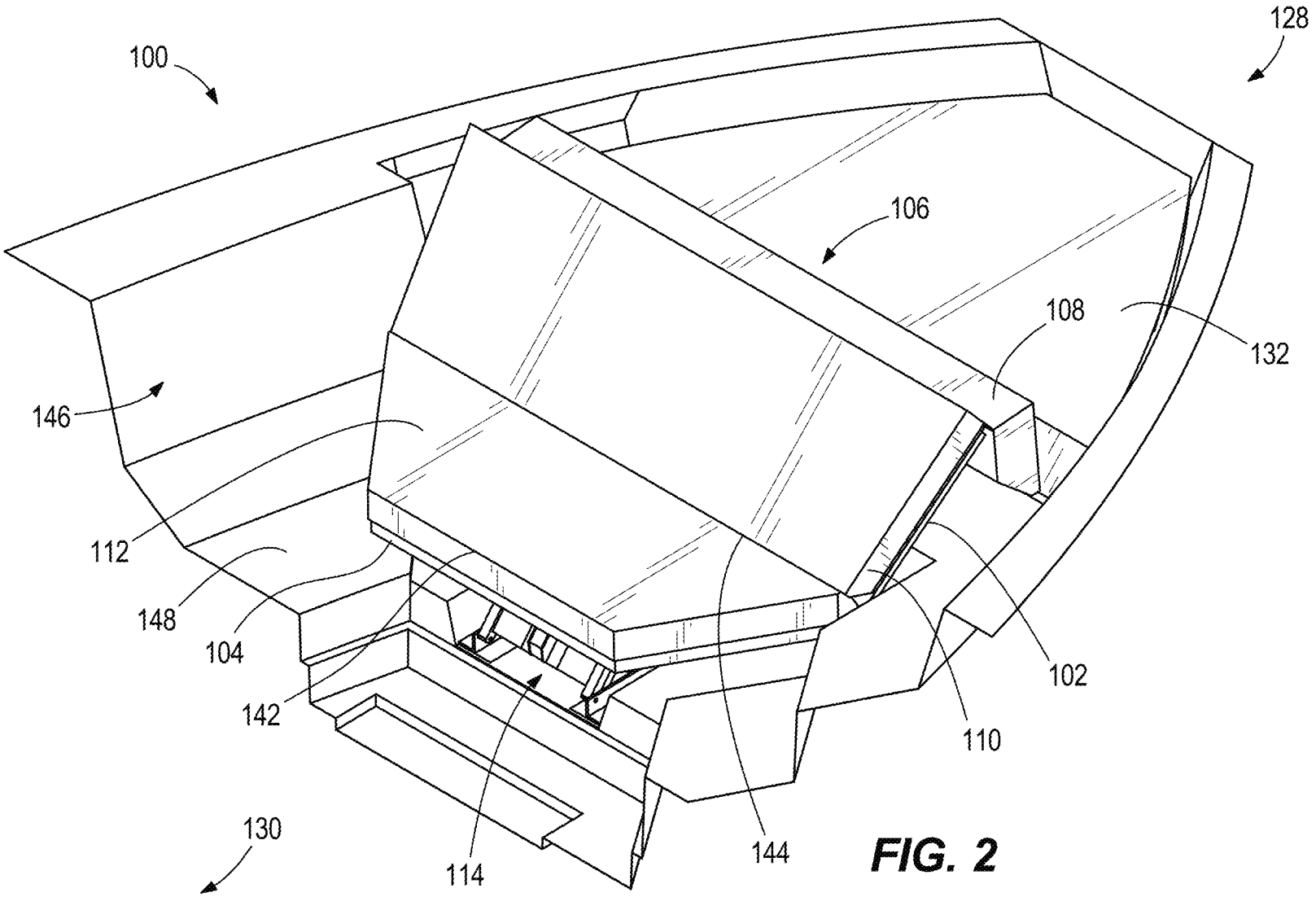
FIG. 2 is a perspective view of the convertible system of FIG. 1 in a transitional configuration.

In the present description, certain terms have been used for brevity, clarity, and understanding. No unnecessary limitations are to be inferred therefrom beyond the requirement of the prior art because such terms are used for descriptive purposes only and are intended to be broadly construed.

FIGS. 1-7 depict a convertible seating and bed system 100 for a marine vessel. In an exemplary implementation, the convertible seating and bed system 100 may be located in a cabin of the marine vessel that is situated below a main deck (not shown). The present inventor has recognized that cabins of marine vessels are multi-functional spaces that are often required to support a variety of activities, including recreation, eating, and sleeping. At the same time, cabins are generally small spaces in which it is difficult to fit furniture dedicated to each of these activities. The convertible system 100 of the present invention alleviates these difficulties by providing a multi-functional system that provides both a comfortable lounge seat and a raised bed that cach consume a minimal footprint within the cabin.

The convertible system 100 is shown to include a backrest structural component 102 and a seating structural component 104. In the seating configuration of the convertible system 100 (depicted in FIGS. 1 and 5), the seating component 104 is generally horizontal or parallel to the lower deck of the marine vessel, and the backrest component 102 is inclined relative to the seating component 104 such that a user can sit on the seating component 104 and rest upon the backrest component 102 in a generally upright position. An actuator assembly 114 is shown to be located below the seating component 104 within a recessed region 124 (depicted in FIG. 5) of the lower deck surface 126 of the marine vessel. As described in further detail below, the actuator assembly 114 acts to drive the convertible system 100 between the seating configuration (depicted in FIGS. 1 and 5), through a transitional configuration (depicted in FIGS. 2 and 6), and into a bed configuration (depicted in FIGS. 3 and 7). Similarly, the actuator assembly 114 acts to retract the convertible system 100 from the bed configuration through the transitional configuration and into the seating configuration.

Advantageously, when the convertible system 100 is in the seating configuration, the seating structural component 104 is positioned lower relative to the deck surface 126 in a vertical direction and closer to a bow end 128 of the marine vessel than when the convertible system 100 is in the bed configuration. In the bed configuration, the seating structural component 104 is moved upwardly and rearwardly such that it is ultimately positioned higher relative to the deck surface 126 and closer to a stern end 130 of the marine vessel. By positioning the seating structural component 104 in this way, minimal deck space is consumed by the convertible system 100 in the seating configuration, and an ergonomically favorable raised bed configuration is also provided.

Figure 4:
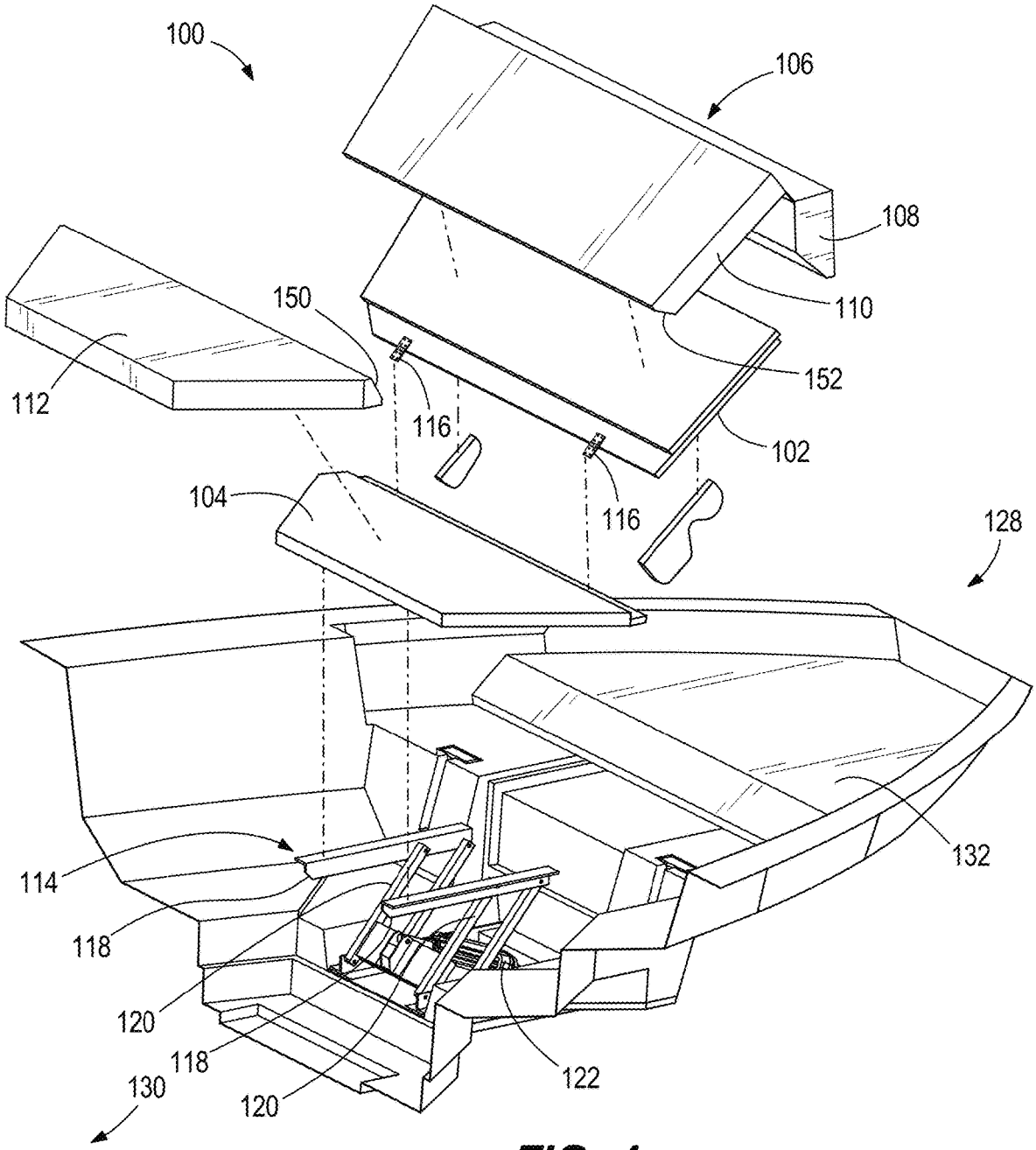
FIG. 4 is an exploded view of the convertible system of FIG. 1.

As best shown in FIG. 4, the backrest structural component 102 is coupled to the seating structural component 104 using a pair of hinges 116. The style of the hinges 116 is not particularly limited, and may be any type of heavy duty hinge. The hinges 116 pivotably couple the backrest structural component 102 to the seating structural component 104 such that the seating structural component 104 rotates between an inclined position and a horizontal position relative to the backrest structural component 102 as the actuator assembly 114 drives the seating structural component 104 between the seating, transitional, and bed configurations.

A backrest cushion 106 is shown to be coupled to the backrest structural component 102, and a seat cushion 112 is shown to be coupled to the seating structural component 104. In an exemplary implementation, both the seating structural component 104 and the seat cushion 112 have a trapezoidal shape with a long edge 144 of the trapezoidal shape positioned proximate the bow end 128 of the marine vessel, and a short edge 142 of the trapezoidal shape positioned proximate the stern end 130 of the marine vessel (see FIGS. 1-3). In an exemplary implementation, the marine vessel is also shown to include an L-shaped sofa 146 (see FIGS. 1-3) with a seating surface 148 that is stationary and generally orthogonal to the seating surface provided by the seating structural component 104 and the seat cushion 112. The trapezoidal shape of the seating structural component 104 and the seat cushion 112 provides a seating surface that is contiguous with the seating surface 148, thereby maximizing the seating collectively provided by the convertible system 100 and the L-shaped sofa 146.

Figure 3:
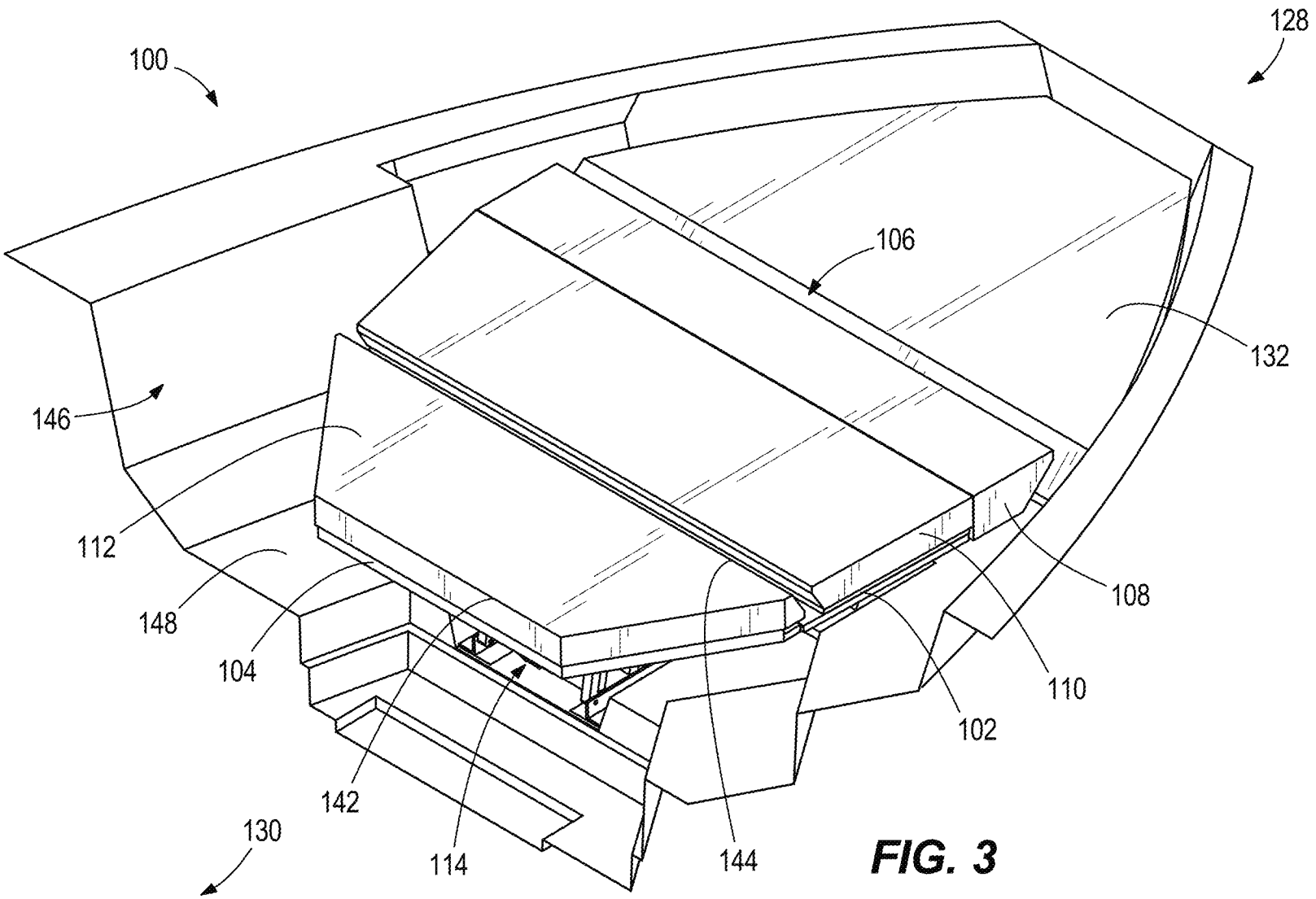
FIG. 3 is a perspective view of the convertible system of FIG. 1 in a bed configuration.
Figure 7:
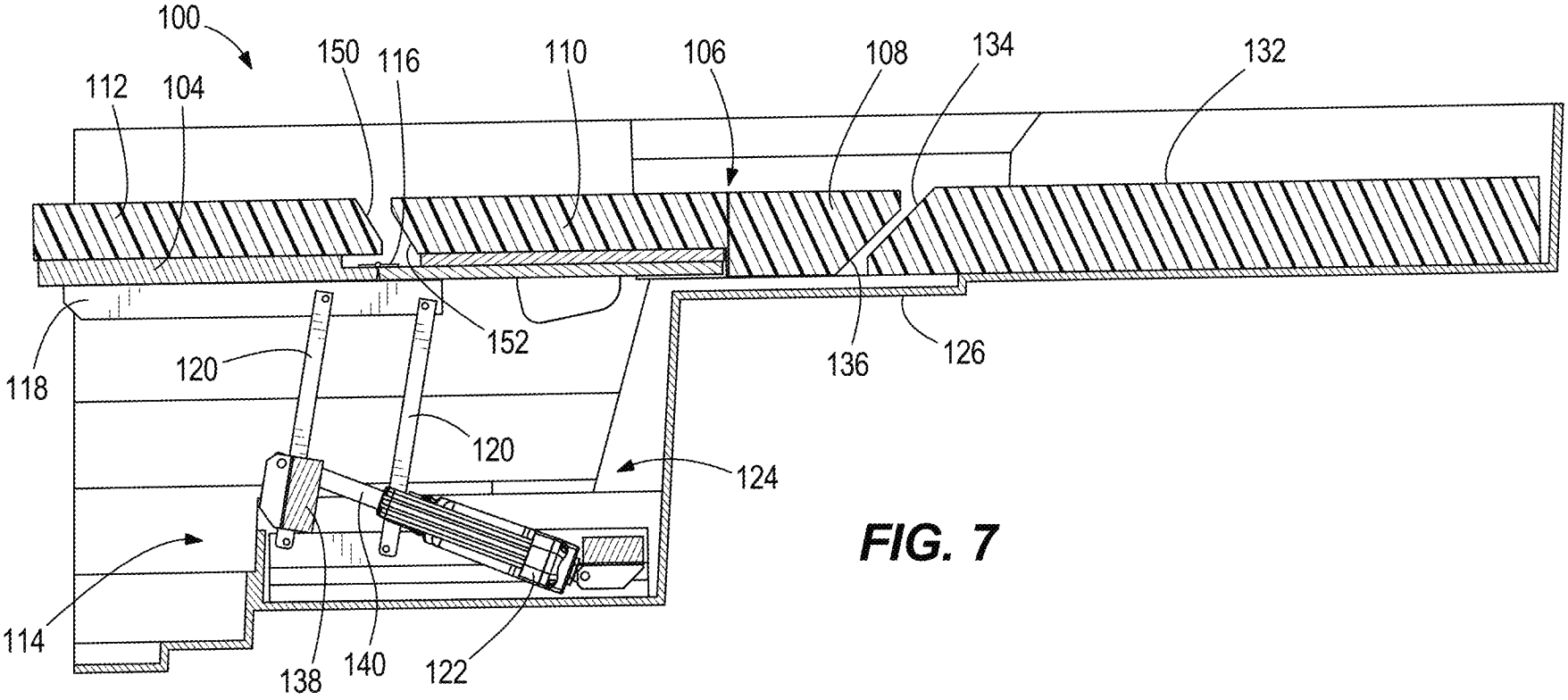
FIG. 7 is a side cross-sectional view of the convertible system of FIG. 1 in the bed configuration.

The backrest cushion 106 is shown to include a first backrest cushion component 108 and a second backrest cushion component 110 (see especially FIGS. 3 and 7). In an exemplary implementation, the first backrest cushion component 108 and the second backrest cushion component 110 are joined by a living hinge that permit the cushions 108, 110 to freely pivot relative to each other. As the convertible seating system 100 transitions from the seating configuration to the bed configuration, the first backrest cushion component 108 is pivoted upwardly to span the region between the backrest structural component 102 and a stationary bow support component 132. In this way, a generally continuous bedding surface (i.e., a surface of constant height) is provided that extends from the bow support component 132 at the bow end 128 of the marine vessel to the seat cushion 112 closer to the stern end 130 of the marine vessel (see FIG. 7). By raising the first backrest cushion component 108, the second backrest cushion component 110, and the seat cushion 112 to the height of the bow support component 132, the surface area of the bow support component 132 is included in the total bedding surface area, thus maximizing the space and comfort of the bed configuration. In other implementations, cushion component 108 is separate from the cushion component 110 and is instead coupled to the bow support component 132 using a living hinge. Before transitioning from the seating configuration to the bed configuration, the cushion component 108 may be pivoted upwardly using the living hinge relative to the bow support component 132. Once the convertible seating system 100 is in the bed configuration, the cushion component 108 may be pivoted downwardly using the living hinge such that cushion components 108-112 and 132 form a generally continuous surface.

Figure 5:
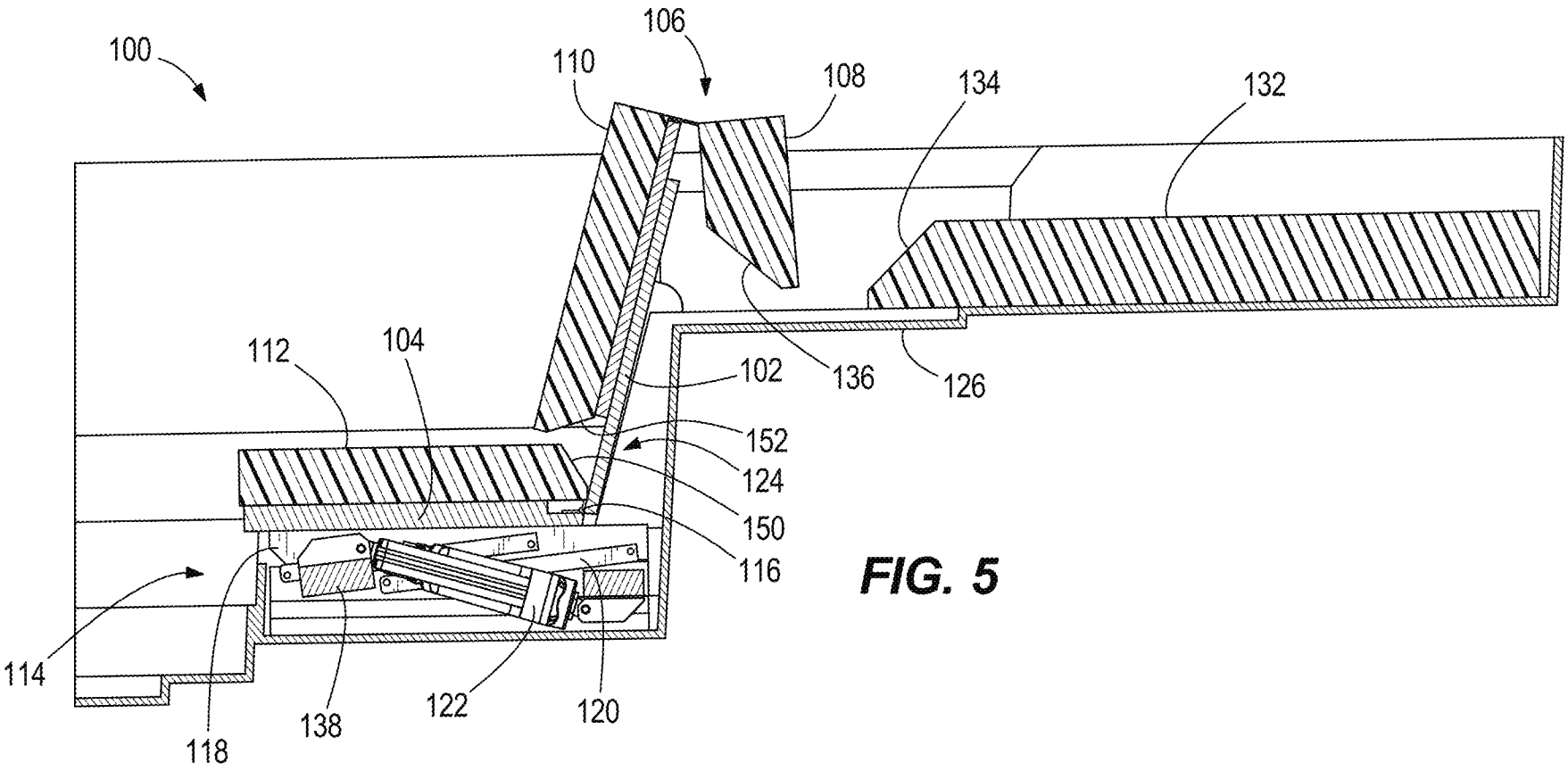
FIG. 5 is side cross-sectional view of the convertible system taken along the line 5-5 in FIG. 1.
Figure 6:
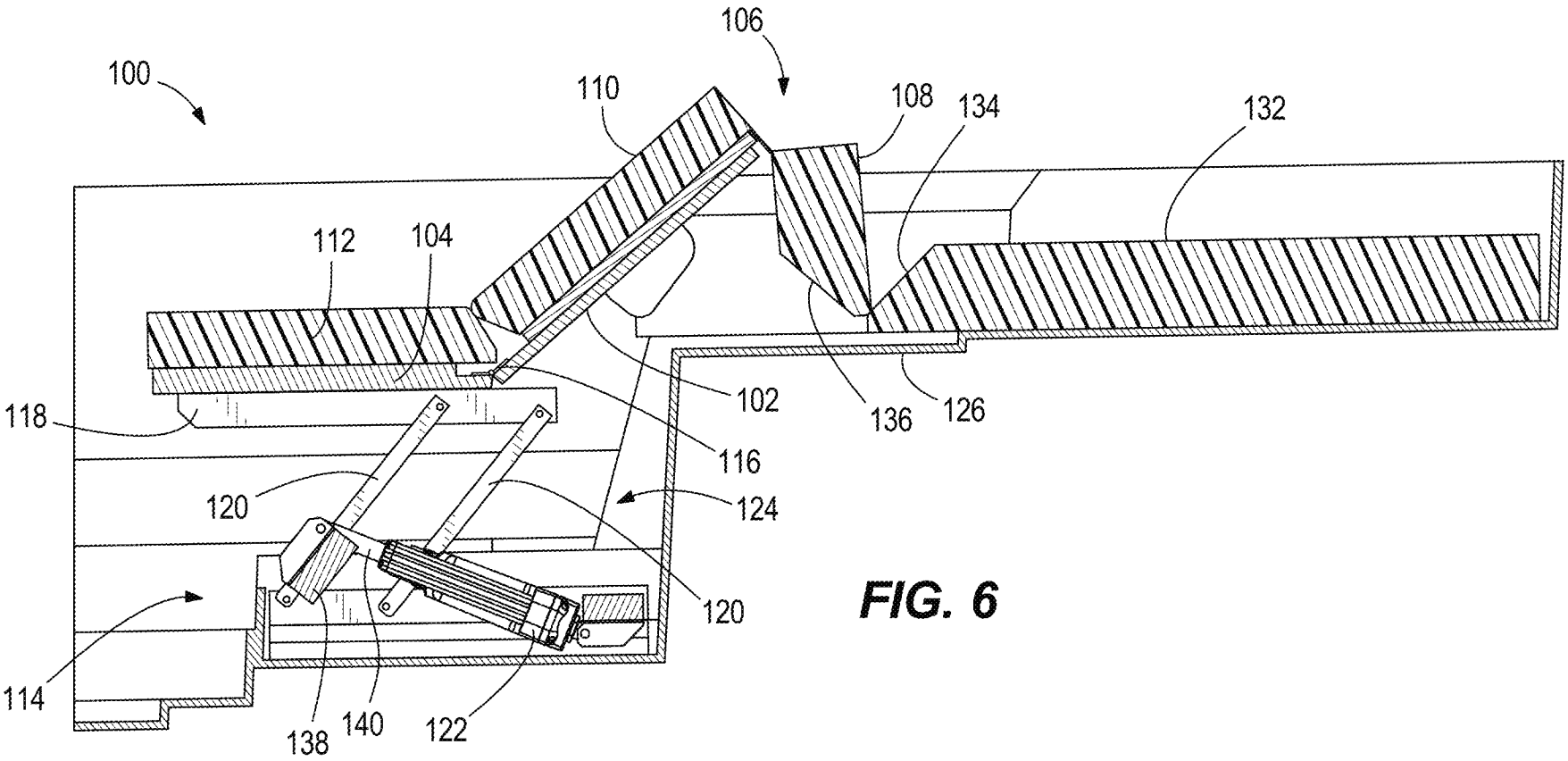
FIG. 6 is a side cross-sectional view of the convertible system of FIG. 1 in the transitional configuration.

As best shown in FIGS. 5-7, respective facing surfaces 136 and 138 of the first backrest cushion component 108 and the bow support component 132 are provided that are inclined, rather than exclusively orthogonal, to the horizontal surfaces of the cushion component 108 and the support component 132 when the convertible seating system 100 is in the bed configuration. Similarly, the cushions 106, 108 may include facing surfaces 150, 152 that are inclined relative to the structural components 102, 104. Advantageously, the inclined surfaces 136, 138 and 150, 152 ensure that adequate clearance is maintained between the cushions 108, 132 and 106, 108 such that the convertible system 100 can freely transition between the different configurations. At the same time, gaps in the horizontal direction between the cushions 108, 132 and 106, 108 that might decrease the comfort of bedding surface are minimized.

As described above, actuator assembly 114 is utilized to drive the convertible seating system 100 between the seating and bed configurations. In an exemplary implementation, control of the actuator assembly 114 is effectuated by a push button or switch that is provided on a control panel (not shown) that is spaced apart from the convertible seating system 100. For example, the control panel may include controls for other marine vessel cabin systems (e.g., TV systems, sound systems, lighting). In other implementations, control of the actuator assembly 114 is effectuated using a push button or switch that is integrated into one of the components of the convertible seating system 100.

As best depicted in FIGS. 4-7, the actuator assembly 114 is shown to include a pair of intermediate linkages 118. The intermediate linkages 118 are fixedly coupled to the seating structural component 104 using any suitable fastening mechanism. Each of the pair of intermediate linkages 118 is pivotably coupled to a pair of driving linkages 120, which are in turn coupled to an actuator 122 using a bracket member 138. In an exemplary implementation, the actuator 122 is an electric linear actuator with an actuating rod 140 that is configured to extend and retract based on the signals received from a control device (e.g., push button or switch). For example, a first actuation of a control device that is communicably coupled to the actuator 122 may cause the actuating rod 140 to travel to a fully extended position (see FIG. 7) and drive rotation of the bracket member 138 in a counterclockwise direction. The movement of the bracket member 138 acts to rotate the driving linkages 120 from a generally horizontal orientation when the convertible system 100 is in the seating configuration (depicted in FIG. 5) to a generally vertical orientation when the convertible system 100 is in the bed configuration (depicted in FIG. 7).

This rotation of the driving linkages 120 drives the intermediate linkages 118, and correspondingly, the seating structural component 104, from a lower position relative to the deck surface 126 in the seating configuration, to a higher position relative to the deck surface 126 in the bed configuration. The rotation also drives the intermediate linkages 118 and the seating structural component 104 laterally outward from the deck surface 126 (i.e., away from the backrest structural component 102) and toward the stern end 130 of the marine vessel such that the backrest structural component 102 has adequate clearance to pivot downwardly into the bed configuration (sec FIGS. 3 and 7).

Upon subsequent actuation of a control device that is communicably coupled to the actuator 122, the actuating rod 140 retracts and pulls the bracket member 138, causing it to rotate in a clockwise direction. This movement of the bracket member 138 acts to rotate the driving linkages 120 from the generally vertical orientation when the convertible system 100 is in the bed configuration (depicted in FIG. 7) back into a generally horizontal orientation to return the convertible system 100 to the seating configuration (see FIG. 5). Thus, transition of the convertible system 100 between the seating and bed configurations is achieved.

In the present disclosure, certain terms have been used for brevity, clarity, and understanding. No unnecessary limitations are to be implied therefrom beyond the requirement of the prior art because such terms are used for descriptive purposes only and are intended to be broadly construed. The different systems and methods described herein may be used alone or in combination with other systems and devices. Various equivalents, alternatives and modifications are possible within the scope of the appended claims.

What is claimed is:

1. A convertible seating system for a marine vessel that is movable between a seating configuration and a bed configuration, the convertible seating system comprising:
- a seating structural component;
- a backrest structural component that is pivotably coupled to the seating structural component; and
- an actuator assembly coupled to the seating structural component and positioned within a recessed portion of a deck surface of the marine vessel, wherein the actuator assembly is configured to drive the seating structural component from a lower and inward position relative to the deck surface when the convertible seating system is in the seating configuration to a higher and outward position relative to the deck surface when the convertible seating system is in the bed configuration.

2. The convertible seating system of claim 1, further comprising a seat cushion component that is coupled to the seating structural component.

3. The convertible seating system of claim 2, wherein the seat cushion component has a trapezoidal shape with a long edge positioned proximate a bow end of the marine vessel and a short edge positioned proximate a stern end of the marine vessel.

4. The convertible seating system of claim 2, wherein a seating surface provided by the seat cushion component is contiguous with a seating surface provided by a stationary sofa system when the convertible seating system is in the seating configuration.

5. The convertible seating system of claim 2, further comprising a first backrest cushion component and a second backrest cushion component, wherein the first backrest cushion component and the second backrest cushion component are coupled to each other using a living hinge, and wherein the second backrest cushion component is coupled to the backrest structural component.

6. The convertible seating system of claim 5, wherein a bedding surface provided by the seat cushion component, the first backrest cushion component, and the second backrest cushion component is of a continuous height with a bedding surface provided by a support component positioned proximate a bow end of the marine vessel when the convertible seating system is in the bed configuration.

7. The convertible seating system of claim 1, wherein the actuator assembly comprises a linear actuator with an actuating rod that is in a retracted position when the convertible seating system is in the seating configuration and an extended position when the convertible seating system is in the bed configuration.

8. The convertible seating system of claim 7, wherein movement of the actuating rod from the retracted position to the extended position drives rotation of a plurality of driving linkages, and
- wherein the plurality of driving linkages are pivotably coupled to a plurality of intermediate linkages that are fixedly coupled to the seating structural component.

9. The convertible seating system of claim 8, wherein the plurality of driving linkages are positioned in a substantially horizontal orientation when the convertible seating system is in the seating configuration; and
- wherein the plurality of driving linkages are positioned in a substantially vertical orientation when the convertible seating system is in the bed configuration.

10. A convertible seating system for a marine vessel that is movable between a seating configuration and a bed configuration, the convertible seating system comprising:
- a seating structural component;
- a backrest structural component that is pivotably coupled to the seating structural component; and
- an actuator assembly coupled to the seating structural component and positioned within a recessed portion of a deck surface of the marine vessel, the actuator assembly configured to drive the seating structural component between the seating configuration and the bed configuration;
- wherein a seating surface provided by the convertible seating system is contiguous with a seating surface provided by a stationary sofa system when the convertible seating system is in the seating configuration; and
- wherein a bed surface provided by the convertible seating system is of a continuous height with a bed surface provided by a stationary support component when the convertible seating system is in the bed configuration.

11. The convertible seating system of claim 10, wherein a height of the seating surface provided by the convertible seating system in the seating configuration is not equal to a height of the bed surface provided by the convertible seating system in the bed configuration.

12. The convertible seating system of claim 11, wherein the height of the bed surface is greater than the height of the seating surface.

13. The convertible seating system of claim 10, further comprising a seat cushion component that is coupled to the seating structural component.

14. The convertible seating system of claim 13, further comprising a first cushion component and a second cushion component, wherein the first cushion component is coupled to the stationary support component using a living hinge, and wherein the second cushion component is coupled to the backrest structural component.

15. The convertible seating system of claim 14, wherein the first cushion component is configured to pivot upwardly as the seating structural component is driven from the seating configuration to the bed configuration.

16. The convertible seating system of claim 10, wherein the actuator assembly comprises a linear actuator with an actuating rod that is in a retracted position when the convertible seating system is in the seating configuration and an extended position when the convertible seating system is in the bed configuration.

17. The convertible seating system of claim 16, wherein movement of the actuating rod from the retracted position to the extended position drives rotation of a plurality of driving linkages, and wherein the plurality of driving linkages are pivotably coupled to a plurality of intermediate linkages that are fixedly coupled to the seating structural component.

18. The convertible seating system of claim 17, wherein the plurality of driving linkages are positioned in a substantially horizontal orientation when the convertible seating system is in the seating configuration; and wherein the plurality of driving linkages are positioned in a substantially vertical orientation when the convertible seating system is in the bed configuration.

19. A convertible seating system for a marine vessel that is movable between a seating configuration and a bed configuration, the convertible seating system comprising:

a seating structural component;

a backrest structural component that is pivotably coupled to the seating structural component; and an actuator assembly coupled to the seating structural component and positioned within a recessed portion of a deck surface of the marine vessel, the actuator assembly configured to drive the seating structural component between a first height when the convertible seating system is in the seating configuration and a second height when the convertible seating system is in the bed configuration;

wherein the first height is not equal to the second height.

20. The convertible seating system of claim 19, wherein the second height is greater than the first height.

* * * * *